US006708376B1

(12) United States Patent
Landry

(10) Patent No.: US 6,708,376 B1
(45) Date of Patent: Mar. 23, 2004

(54) LENGTH ADJUSTMENT MECHANISM FOR A STRAP

(75) Inventor: Michel Landry, Mascouche (CA)

(73) Assignee: North Safety Products Ltd., Anjou (CA)

( * ) Notice: Subject to any disclaimer, the term of this patent is extended or adjusted under 35 U.S.C. 154(b) by 0 days.

(21) Appl. No.: 10/262,629

(22) Filed: Oct. 1, 2002

(51) Int. Cl.[7] ..... A42B 3/14

(52) U.S. Cl. ..... 24/68 R; 24/68 B; 36/50.5; 2/418; 74/89.17

(58) Field of Search ..... 24/71.1, 685 K, 24/68 B, 68 R; 36/50.5; 2/417, 418, 426; 74/29, 30, 89.12, 89.17, 569

(56) References Cited

U.S. PATENT DOCUMENTS

| | | | | | |
|---|---|---|---|---|---|
| 553,399 | A | | 1/1896 | Esterhazy | |
| 2,511,234 | A | * | 6/1950 | Anderson | 24/71.1 X |
| 2,550,575 | A | * | 4/1951 | Malcom | 2/8 |
| 2,926,406 | A | * | 3/1960 | Edwards et al. | 24/68 B |
| 3,041,622 | A | * | 7/1962 | Gurtowski | 2/8 |
| 3,090,046 | A | * | 5/1963 | Bowers, Sr. | 74/89.17 |
| 3,214,809 | A | | 11/1965 | Edwards | |
| 3,325,824 | A | * | 6/1967 | Donegan | 24/68 B |
| 3,329,968 | A | | 7/1967 | Gordon | |
| 3,444,560 | A | * | 5/1969 | Northup, Jr. | 2/8 |
| 3,500,474 | A | | 3/1970 | Austin | |
| 3,729,779 | A | * | 5/1973 | Porth | 24/68 SK |
| 3,992,720 | A | | 11/1976 | Nicolinas | 2/418 |
| 4,297,747 | A | | 11/1981 | Nava | 2/424 |
| 4,345,792 | A | | 8/1982 | Shephard | 297/362 |
| 4,888,831 | A | * | 12/1989 | Oleson | 2/420 |
| 4,942,628 | A | | 7/1990 | Freund | 2/416 |
| 5,357,654 | A | | 10/1994 | Hsing-Chi | 24/68 |
| 5,373,588 | A | | 12/1994 | Hede et al. | 2/418 |
| 5,600,874 | A | * | 2/1997 | Jungkind | 24/68 SK |
| 5,950,245 | A | | 9/1999 | Binduga | 2/417 |
| 6,256,798 | B1 | | 7/2001 | Egolf et al. | 2/421 |
| 6,314,588 | B1 | * | 11/2001 | Fang | 2/418 |
| 2002/0007508 | A1 | | 1/2002 | Grepper et al. | 2/420 |

FOREIGN PATENT DOCUMENTS

| | | |
|---|---|---|
| GB | 2362802 | 12/2001 |

OTHER PUBLICATIONS

Extract from the GIRO website showing different helmet adjustment systems, Nov., 2002.
Technical pamphlet of SOFOP S.A. showing the ALBATROS and the OPUS helmets. Nov., 2002.

* cited by examiner

*Primary Examiner*—Robert J. Sandy
(74) *Attorney, Agent, or Firm*—Testa, Hurwitz & Thibeault LLP

(57) ABSTRACT

A length adjustment mechanism for a strap having a row of teeth. The mechanism comprises a pinion for meshing with the row of teeth and a finger operable actuator pivotable in a first direction and a second direction. The mechanism also comprises a pivoting link coupled with the pinion, the pivoting link being pivotable about a first pivot axis to impart pivotal movement to the pinion. The mechanism further comprises a rotating element coupled with the finger operable actuator and being pivotable about a second pivot axis. The rotating element engages the pivoting link in a driving relationship such that movement of the finger operable actuator is communicated to the pinion via the rotating element and the pivoting link to displace the strap. When a force is applied to the pinion for tending to pivot the pivoting link, the pivoting link and the rotating element interlock for resisting pivotal movement of the pinion.

25 Claims, 8 Drawing Sheets

LENGTH ADJUSTMENT MECHANISM FOR A STRAP

FIELD OF THE INVENTION

The invention relates to a length adjustment mechanism for a strap.

BACKGROUND OF THE INVENTION

U.S. Pat. No. 3,214,809 issued to Edwards on Dec. 20, 1963 discloses a length adjustment mechanism for a strap having overlapping portions. U.S. Pat. No. 5,950,245 issued to Binduga on Sep. 14, 1999 discloses an adjustable headband comprising a ratchet mechanism having different resistances.

Although these prior art adjustable mechanisms allow adjusting the length of a strap when desired by the user while normally preventing undesirable movement of the strap, such movement is nevertheless possible when the force applied to the strap exceeds a certain level.

Against this background, there is a need in the industry for a mechanism that allows the length of the strap to be easily adjusted by the user while preventing or at least reducing the possibility of unwanted loosening or tightening of the strap.

SUMMARY OF THE INVENTION

As embodied and broadly described herein, the invention seeks to provide a length adjustment mechanism for a strap having a row of teeth. The mechanism comprises a pinion for meshing with the row of teeth and a finger operable actuator pivotable in a first direction and in a second direction. The mechanism also comprises a pivoting link coupled to the pinion, the pivoting link being pivotable about a first pivot axis to impart a pivotal movement to the pinion and a rotating element coupled with the finger operable actuator. The rotating element is pivotable about a second pivot axis and engages the pivoting link in a driving relationship such that movement imparted to the finger operable actuator is communicated to the pinion via the rotating element and the pivoting link to displace the row of teeth.

BRIEF DESCRIPTION OF THE DRAWINGS

A detailed description of the preferred embodiments of the present invention is provided herein below, by way of example only, with reference to the accompanying drawings, in which.

Figure 1:
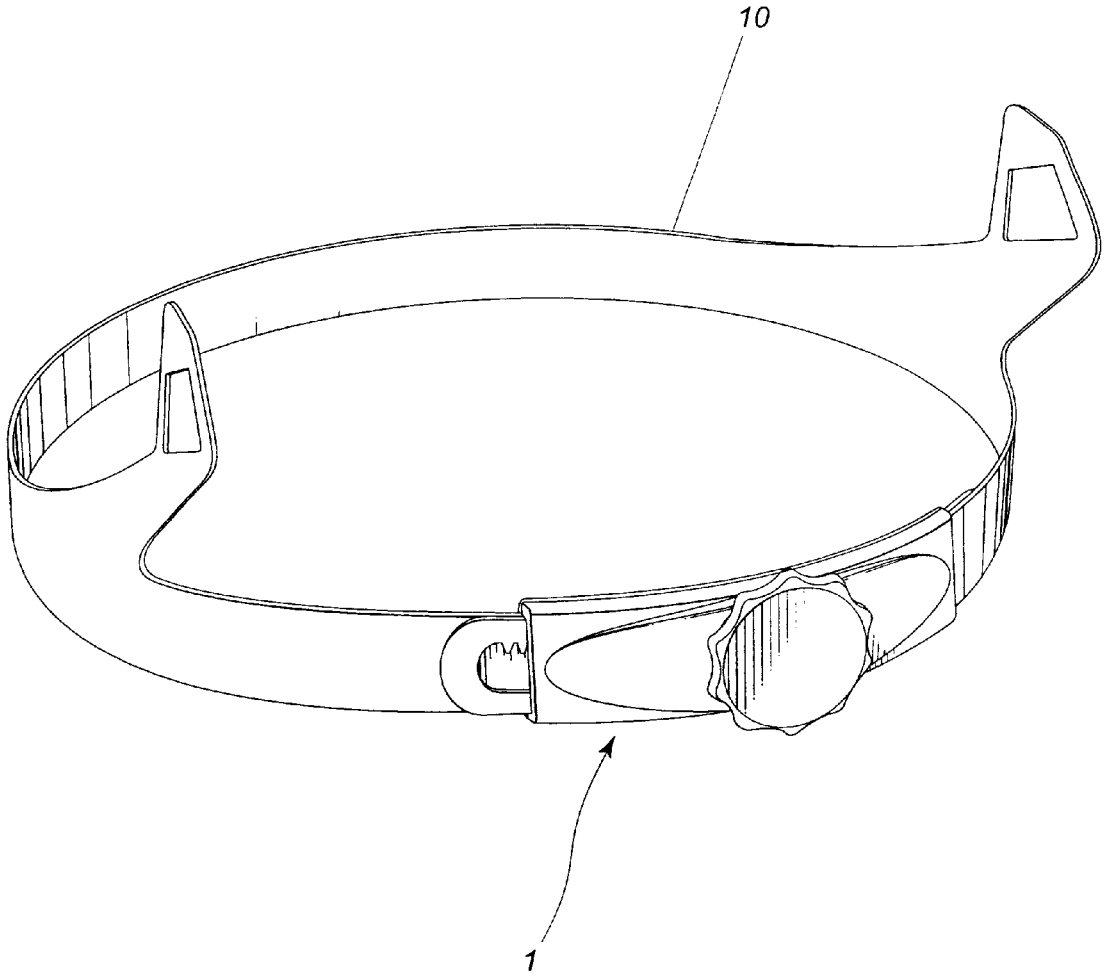
FIG. 1 is a perspective view of a strap having a length adjustment mechanism constructed in accordance with a first embodiment of the invention.
Figure 2:
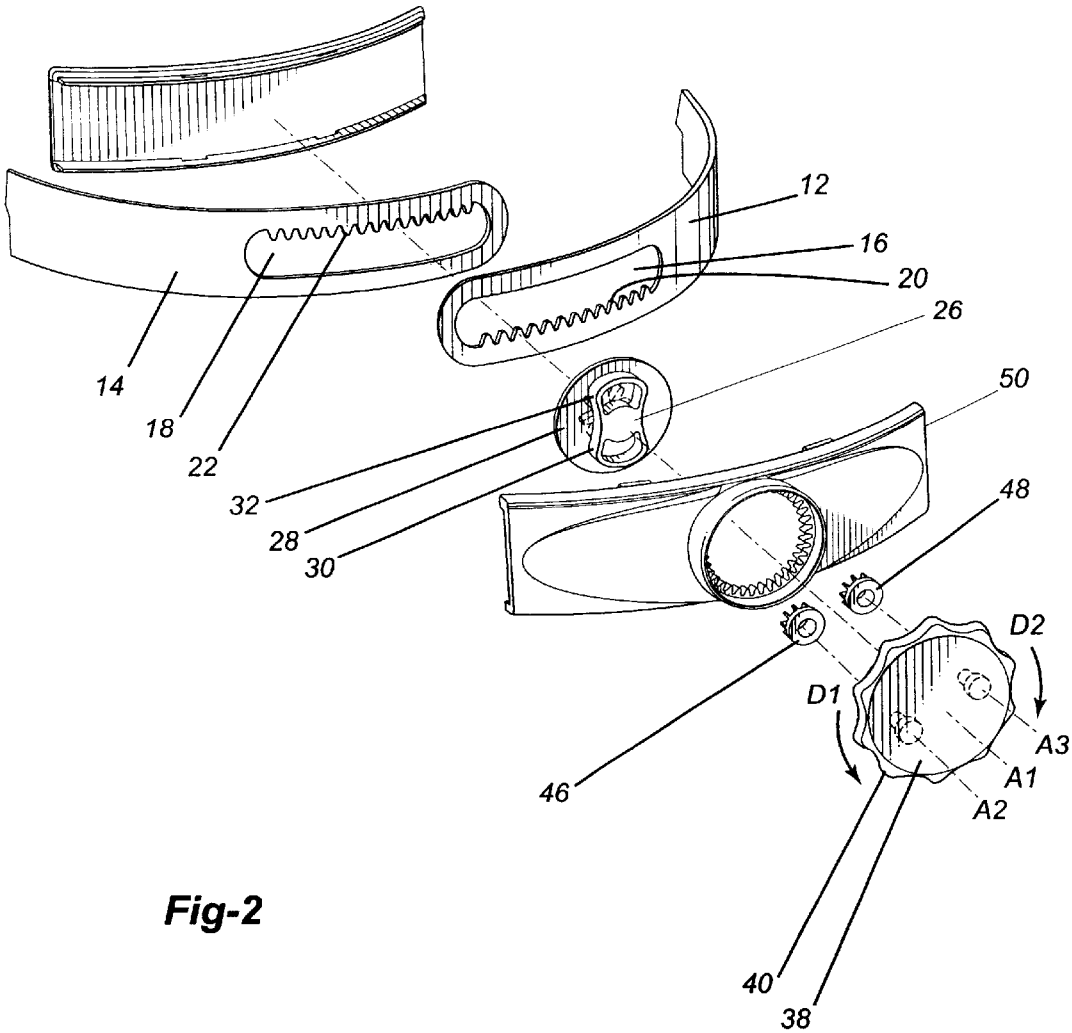
FIG. 2 is a perspective exploded view of the mechanism of FIG. 1.
Figure 3:
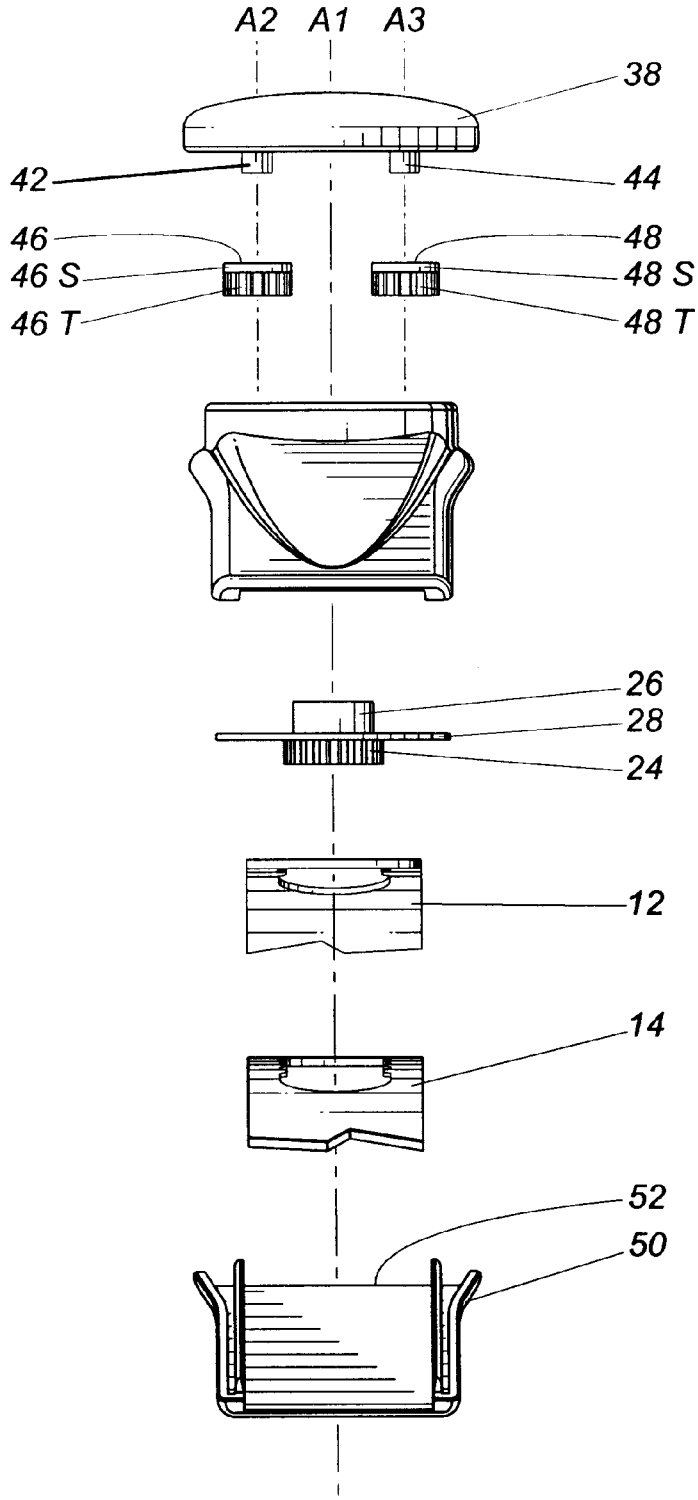
FIG. 3 is an elevational exploded view of the mechanism of FIG. 2.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENT

FIGS. 1 to 6 show a length adjustment mechanism 1 constructed in accordance with a first embodiment of the invention, mechanism 1 being mounted on a strap 10 for adjusting the length of the strap 10.

Strap 10 comprises first and second overlapping portions 12 and 14. Overlapping portions 12 and 14 have respective first and second elongated slots 16 and 18 with opposite first and second rows of teeth 20 and 22. Elongated slots 16 and 18 are in general alignment.

Mechanism 1 comprises a pinion 24 having teeth meshing with first and second rows of teeth 20 and 22. Pinion 24 is coupled to a pivoting link 26. A disc 28 is provided between pinion 24 and pivoting link 26. Preferably, pinion 24, pivoting link 26 and disc 28 are integrally formed. Thus, pinion 24, pivoting link 26 and disc 28 are pivotable about a first pivot axis A1 and pivoting link 26 imparts a pivotal movement to pinion 24 (and disc 28).

It is understood that it is not essential that disc 28 pivots and be integrally formed with pinion 24 and/or pivoting link 26. While pinion 24 is coupled to pivoting link 26 and pivots about first pivot axis A1, it is also understood that this pinion may pivot about another pivot axis or may be coupled to pivoting link 26 via another driving component which pivots about first pivot axis A1.

Pivoting link 26 comprises first and second surfaces 30, 32 that define therebetween an angle less than 180°, and third and fourth surfaces 34, 36 that also define therebetween an angle less than 180°.

Mechanism 1 further comprises a finger operable actuator 38 having a gripping portion 40 for allowing a user to turn the finger operable actuator 38 in a first direction D1 or in a second direction D2 that is opposite to direction D1. Finger operable actuator 38 also comprises first and second lugs 42, 44 projecting downwardly and engaging respective second and third satellite rotating elements 46, 48 in order to communicate movement of finger operable actuator 38 to rotating elements 46, 48. In the illustrated embodiments, rotating elements 46, 48 are formed of pinions but it is understood that other types of rotating elements can be used without departing of the scope of the present invention.

Second rotating element 46 is pivotable about a second pivot axis A2 and third rotating element 48 is pivotable about a third pivot axis A3. Second rotating element 46 comprises a first circular section 46T having teeth and a second circular section 46S being free of teeth. Similarly, third rotating element 48 comprises a first circular section 48T having teeth and a second circular section 48S being free of teeth.

Mechanism 1 further includes a casing 50 having an elongated aperture 52 for receiving overlapping portions 12, 14. Casing 50 has a ring gear 54 with an annular peripheral projection 56 having an internal surface 58 from which originate the teeth of the ring gear. As shown on FIGS. 2 and 5, the diameter of disc 28 is substantially identical to the diameter of ring gear 54 and fits in the peripheral projection 56 in order to properly support rotating elements 46, 48 that are located above disc 28.

Figure 4:
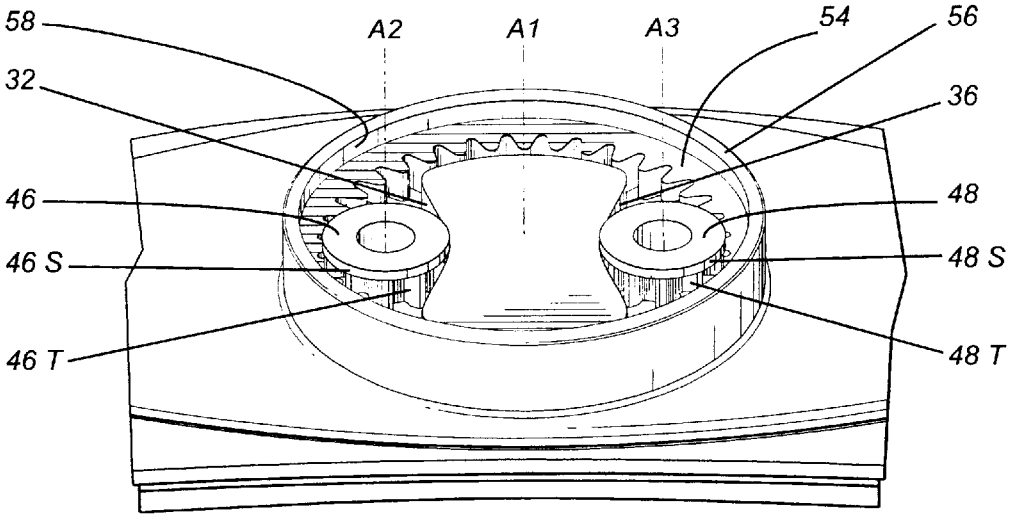
FIG. 4 is a perspective enlarged view of the mechanism, the finger operable actuator of the mechanism being omitted.
Figure 5:
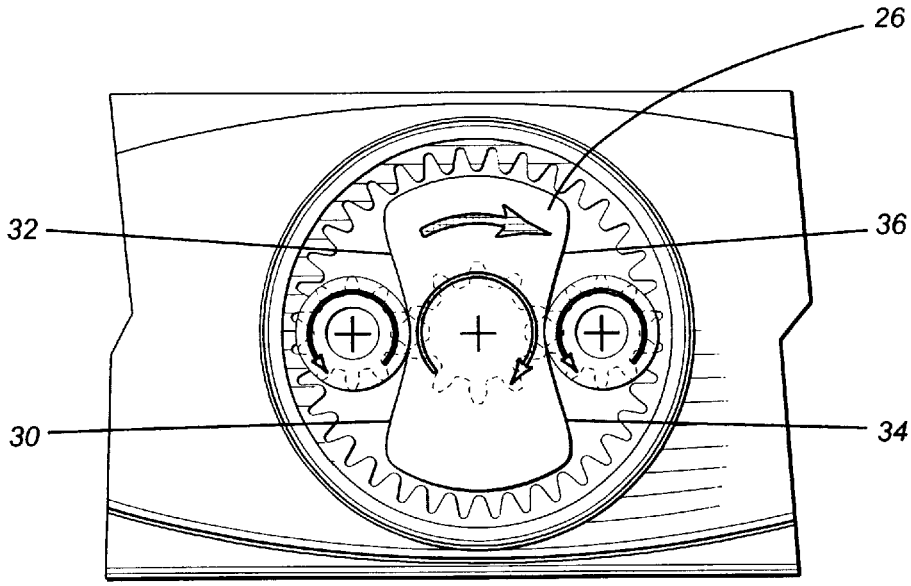
FIG. 5 is a plan view of the mechanism of FIG. 4, arrows showing directions in which components pivot.
Figure 6:
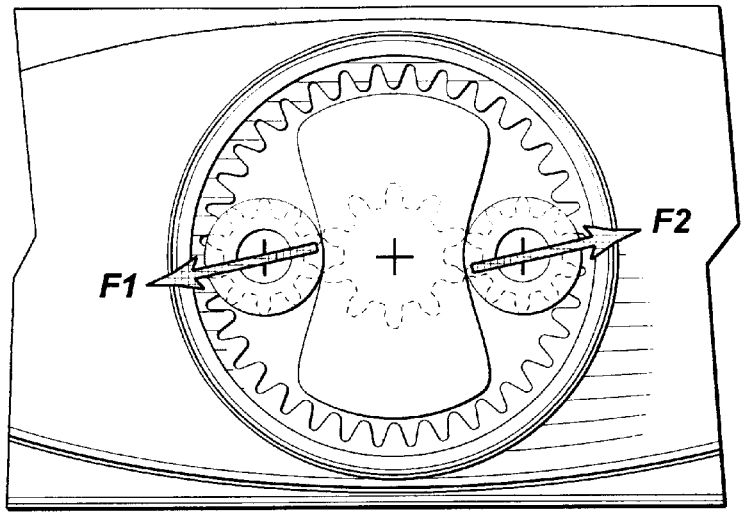
FIG. 6 is a plan view of the mechanism of FIG. 4, arrows showing forces acting between the pivoting link and pinions.

Referring now more specifically to FIGS. 4 to 6, teeth of first circular sections 46T, 48T of second and third rotating elements 46, 48 mesh with ring gear 52, while the second circular section 46S of the second rotating element 46 contacts the first and second surfaces 30, 32 of pivoting link 26. Similarly, the second circular section 48S of third rotating element 48 contacts the third and fourth surfaces 34, 36 of pivoting link 26. Second and third rotating elements 46, 48 are therefore frictionally engage with pivoting link 26 in a driving relationship such that pivotal movement of finger operable actuator 38 is communicated to pinion 24 via rotating elements 46, 48 and pivoting link 26, causing first and second overlapping portions 12, 14 to be displaced in opposite directions to either loosen or tighten the strap 10.

More specifically, when the finger operable actuator 38 is turned by hand, the motion imparts opposite pivotal movement to second and third satellite rotating elements 46, 48 about the second and third pivot axes A2, A3, respectively. Since the teeth of first circular sections 46T, 48T mesh with ring gear 54, satellite rotating elements 46, 48 also pivot in an orbital fashion about first pivot axis A1 in the same direction as finger operable actuator 38.

Furthermore, since a portion of second circular section 46S contacts a portion of first and second surfaces 30, 32 of pivoting link 26 and a portion of second circular section 48S contacts a portion of first and second surfaces 34, 36 of pivoting link 26, the orbital pivotal movement of rotating elements 46, 48 imparts a pivotal movement to pivoting link 26 about the first pivot axis A1.

As pivoting link 26 is coupled to pinion 24, the pivotal movement of the pivoting link 26 imparts pivotal movement of pinion 24 in order to displace first and second overlapping portions 12, 14 in opposite directions. Thus, pivotal movement of finger operable actuator 38 in one direction tightens the strap 10 by moving the overlapping portions 12, 14 toward one another. Conversely, the pivotal movement of the finger operable actuator 38 in the opposite direction loosens the strap 10 by moving the overlapping portions 12, 14 away from one another.

When a force is applied on the strap 10 for loosening or tightening it, such as when the overlapping portions 12, 14 are pulled away or pushed toward one another, the teeth 20, 22 tend to impart a turning movement to pinion 24 and to pivoting link 26. However, the driving relationship between the satellite rotating elements 46, 48 and pivoting link 26 is unidirectional such that the satellite rotating elements 46, 48 and the pivoting link 26 interlock, thus preventing the any one of the rotary components (finger operable actuator 38, satellite rotating elements 46, 48, pivoting link 26 and pinion 24) from turning.

In other words, relative movement between the overlapping portions 12, 14 of strap 10 is precluded when a force is applied to pinion 24 tending to drive pivoting link 26. A turning force imparted on pivoting link 26 by the pivot 24 is transmitted to satellite rotating elements 46, 48. The forces acting on the satellite rotating elements 46, 48 are shown at F1 and F2 in FIG. 6. The geometry of the various parts is such that forces F1 and F2 intersect the respective pivot axes of the satellite rotating elements 48, 48, thus interlocking the mechanism.

Figure 8:
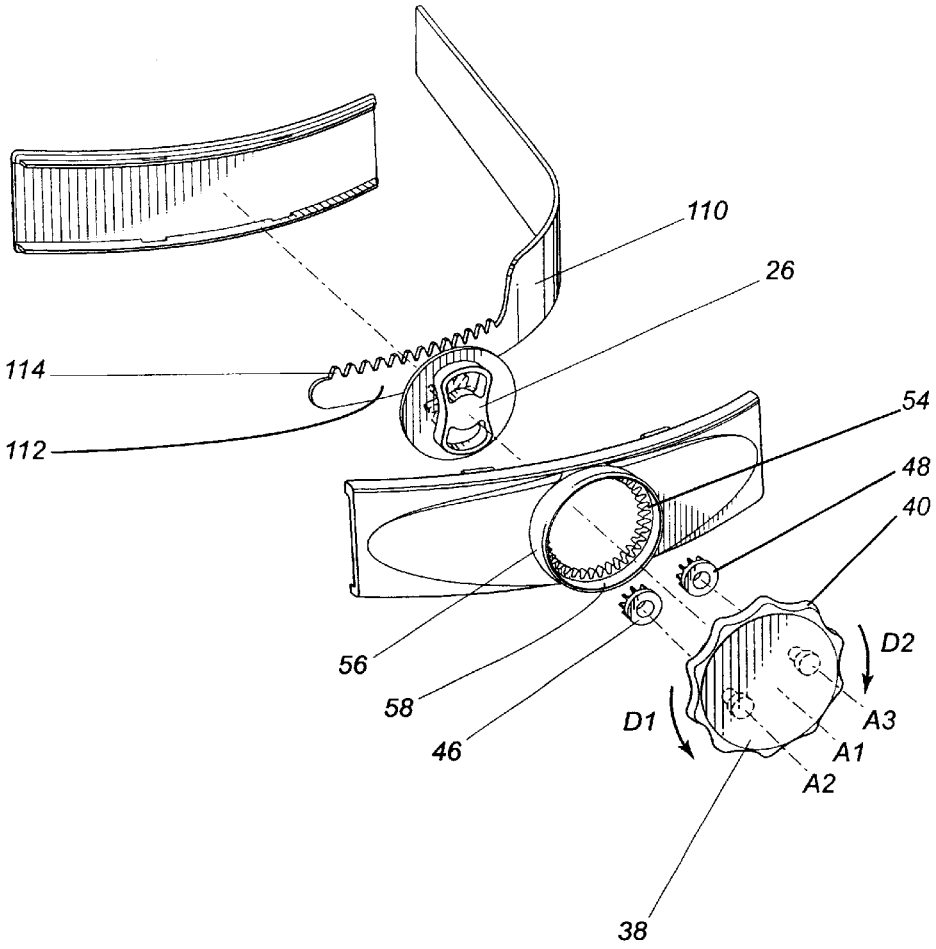
FIG. 8 is a perspective exploded view of the mechanism of FIG. 7.
Figure 9:
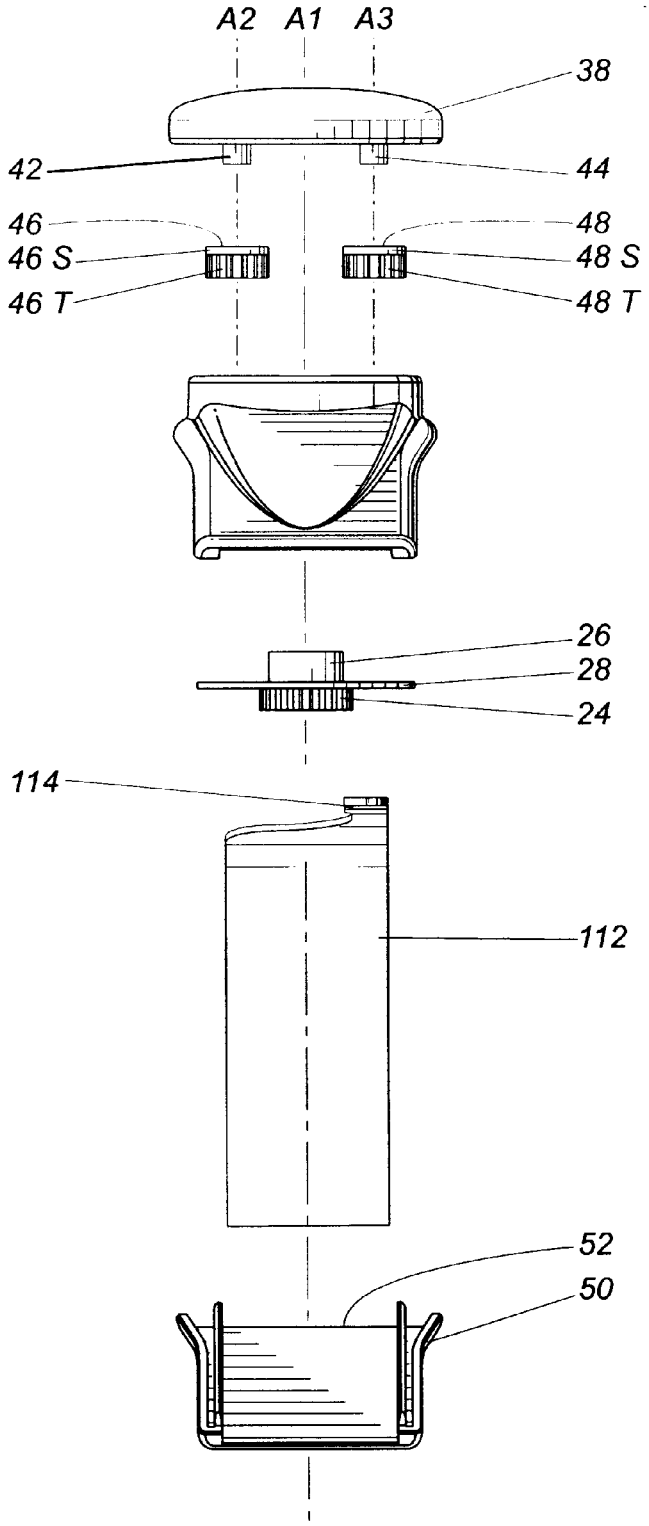
FIG. 9 is an elevational view of the mechanism of FIG. 8.

FIG. 8 shows a length adjustment mechanism 100 constructed in accordance with a second embodiment of the invention, mechanism 100 being mounted on a strap 110. Mechanism 100 for adjusting strap 110 is identical to that of mechanism 1, and the only difference resides in the construction of the strap 110 that has a single part 112 including a row of teeth 114 that can be moved forward or backward such as to tighten or loosen the strap 110.

Figure 7:
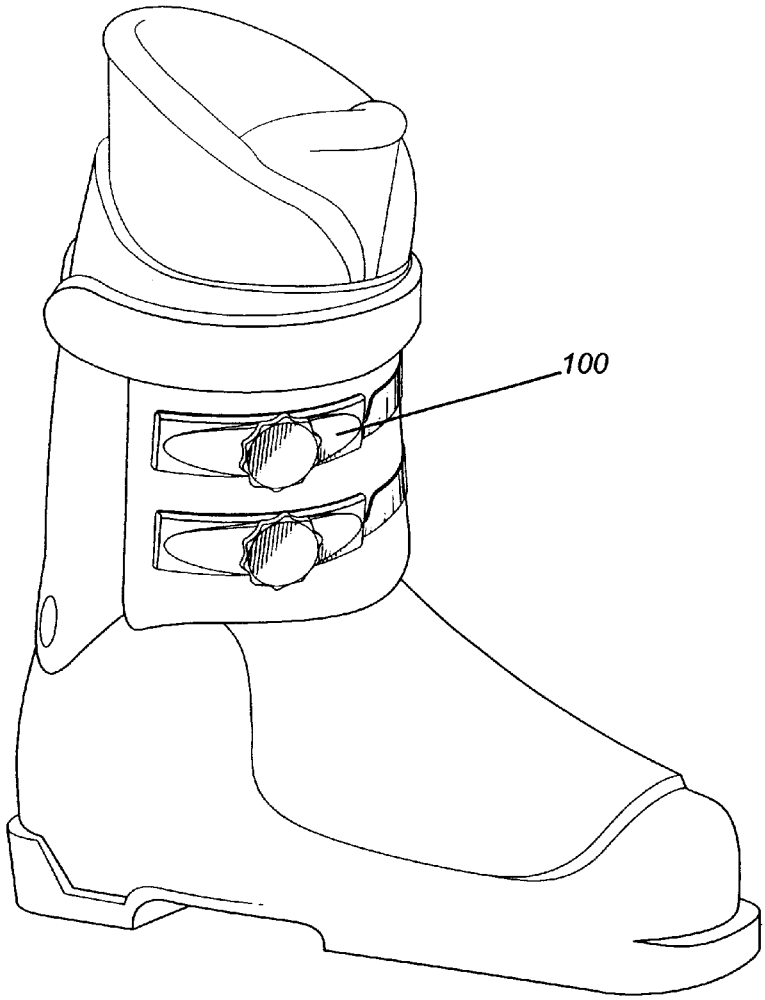
FIG. 7 is a perspective view of a ski boot having straps with a length adjustment mechanism constructed in accordance with a second embodiment.
Figure 10:
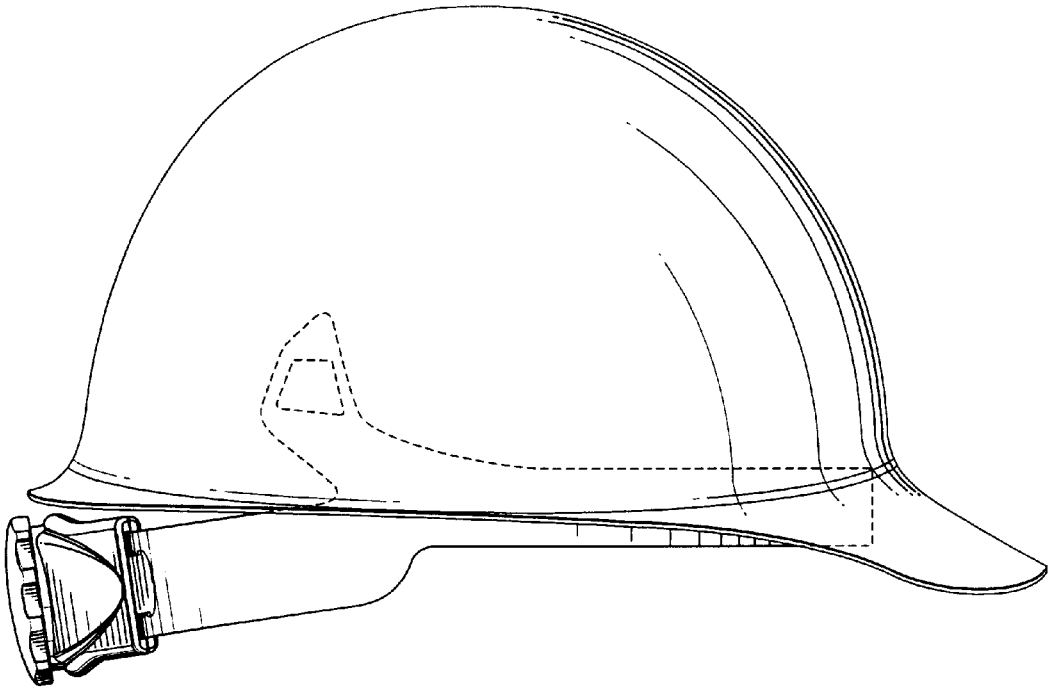
FIG. 10 is a perspective view of a helmet having a headband with a length adjustment mechanism constructed in accordance with the first embodiment.

It will become apparent to a person skilled in the art that the mechanism of the present invention may be used for adjusting the length of a strap in a wide variety of applications, such as the strap forming the headband on a helmet. In fact, the headband may comprise an adjustable strap having the length adjustment mechanism 1. For example, as illustrated in FIGS. 1 and 10, strap 10 may be part of a headband Moreover, as illustrated in FIG. 10, a helmet may comprise the headband The mechanism of the present invention may also be used for adjusting the length of a strap for fastening footwear as illustrated in FIG. 7.

The above description of preferred embodiments should not be interpreted in a limiting manner since other variations, modifications and refinements are possible within the spirit and scope of the present invention. For example, friction drive rollers may replace the various pinions of the mechanism. Also, instead of using a pair of satellite pinions 46, 48, a single satellite pinion can be used. The scope of the invention is defined in the appended claims and their equivalents.

What is claimed is:

1. A length adjustment mechanism for a strap having a row of teeth, said mechanism comprising:

(a) a pinion for meshing with the row of teeth;

(b) a finger operable actuator pivotable in a first direction and in a second direction;

(c) a pivoting link coupled to said pinion, said pivoting link being pivotable about a first pivot axis to impart a pivotal movement to said pinion; and (d) a rotating element coupled with said finger operable actuator, said rotating element being pivotable about a second pivot axis, said rotating element engaging said pivoting link in a driving relationship such that movement imparted to said finger operable actuator is communicated to said pinion via said rotating element and said pivoting link to displace the row of teeth.

2. A length adjustment mechanism as defined in claim 1, wherein when a force is applied to said pinion tending to pivot said pivoting link, said pivoting link and said rotating element interlocking for resisting pivotal movement of said pivoting link.

3. A length adjustment mechanism as defined in claim 2 wherein said pivoting link comprises first and second surfaces defining therebetween an angle less than 180°, a portion of said first and second surfaces of said pivoting link contacting a portion of said rotating element.

4. A length adjustment mechanism as defined in claim 3 wherein said pinion is pivotable about said first pivot axis.

5. A length adjustment mechanism as defined in claim 4 further comprising a casing having an elongated aperture for receiving a portion of the strap, said casing further comprising a ring gear encircling said first pivot axis.

6. A length adjustment mechanism as defined in claim 5 wherein said pinion is a first pinion and said rotating element is a second pinion, said second pinion being meshed with said ring gear.

7. A length adjustment mechanism as defined in claim 6 wherein said second pinion comprises a first section including teeth meshed with said ring gear and a second section frictionally engaging said pivoting link.

8. A length adjustment mechanism as defined in claim 7 wherein said second section of said second pinion is free of teeth.

9. A length adjustment mechanism as defined in claim 8 wherein when said second pinion and said pivoting link interlock, said pivoting link applies a force on said second pinion that is oriented along an axis intersecting said second pivot axis.

10. A length adjustment mechanism as defined in claim 9 further comprising a third pinion pivotable about a third pivot axis, said third pinion being coupled with said finger operable actuator and meshed with said ring gear, said third pinion engaging said pivoting link in a driving relationship such that movement of said finger operable actuator is communicated to said first pinion via said third pinion and said pivoting link to displace the row of teeth.

11. A length adjustment mechanism as defined in claim 10 wherein said third pinion comprises a first section including teeth meshed with said ring gear and a second section frictionally engaging said pivoting link.

12. A length adjustment mechanism as defined in claim 11 wherein said second section of said third pinion is free of teeth.

13. A length adjustment mechanism as defined in claim 12 wherein said force is a first force and said pivoting link comprises third and fourth surfaces defining therebetween an angle less than 180°, and wherein when said third pinion and said pivoting link interlock, said pivoting link applies a second force on said third pinion that is oriented along an axis intersecting said third pivot axis.

14. A length adjustment mechanism as defined in claim 13 wherein said pivoting link is connected to said first pinion, said pivoting link being located above said first pinion.

15. A length adjustment mechanism as defined in claim 14 further comprising a disc, said disc being located between said pivoting link and said first pinion.

16. A length adjustment mechanism as defined in claim 15 wherein said pivoting link, said disc and said first pinion are integrally formed.

17. A length adjustment mechanism as defined in claim 16 wherein said ring gear comprises an annular peripheral projection having an internal surface from which originate teeth, said ring disc has a disc diameter and said ring gear has a ring diameter, said disc diameter being substantially identical to said ring diameter.

18. A length adjustment mechanism as defined in claim 17 wherein said second and third pinions are located above said disc.

19. A length adjustment mechanism as defined in claim 18 wherein said finger operable actuator comprises first and second lugs projecting downwardly along said second and third pivot axes, said first and second lugs engaging said second and third pinions such that said second and third pinions pivot upon actuation of said finger operable actuator.

20. A length adjustment mechanism as defined in claim 19 wherein said finger operable actuator is a knob having a gripping portion.

21. A length adjustment mechanism as defined in claim 19 wherein a portion of said second section of said second pinion contacts a portion of said internal surface of said ring and a portion of said second section of said third pinion contacts another portion of said internal surface of said ring.

22. An adjustable strap having a length adjustment mechanism as defined in claim 1.

23. A headband having the strap as defined in claim 22.

24. A helmet comprising the headband as defined in claim 23.

25. An article of footwear comprising the strap as defined in claim 22.

* * * * *